United States Patent [19]

Heuer

[11] 4,082,102

[45] Apr. 4, 1978

[54] SUNSHADE—FOLDABLE AND HAND-TRANSPORTABLE

[76] Inventor: Hans Herbert Heuer, 8230 Reche Canyon Rd., Colton, Calif. 92324

[21] Appl. No.: 788,990

[22] Filed: Apr. 19, 1977

Related U.S. Application Data

[63] Continuation-in-part of Ser. No. 687,539, May 18, 1976, abandoned.

[51] Int. Cl.[2] ..... E04F 10/00

[52] U.S. Cl. ..... 135/5 R; 135/5 E; 135/7.1 R; 297/184; 403/84; 403/93

[58] Field of Search ..... 135/5 E, 5 R, 7.1 R; 297/184; 403/62, 84, 88, 93, 94, 120, 148

[56] References Cited

U.S. PATENT DOCUMENTS

| | | | |
|---|---|---|---|
| 2,598,588 | 5/1952 | Mullen | 135/5 R |
| 2,828,758 | 4/1958 | Moro | 135/5 R |
| 2,888,021 | 5/1959 | Adams | 135/7.1 R |
| 3,243,230 | 3/1966 | Otto | 135/5 R X |
| 3,305,201 | 2/1967 | Thiel | 135/5 R |
| 3,367,612 | 2/1968 | Usiskin | 403/120 |

FOREIGN PATENT DOCUMENTS

| | | | |
|---|---|---|---|
| 226,939 | 9/1958 | Australia | 135/5 R |
| 66,863 | 7/1945 | Denmark | 135/5 R |
| 1,019,528 | 10/1952 | France | 135/5 R |
| 1,490,621 | 6/1967 | France | 135/5 R |

*Primary Examiner*—Werner H. Schroeder
*Assistant Examiner*—Conrad L. Berman

[57] ABSTRACT

This invention presents a foldable and portable shielding device, which serves to protect the head, in particular the face, of a person against sunburning while sunbathing. Also, to protect small animals, sensitive flowers, objects like cameras, etc., from direct sunlight. At the same time the surface of the shielding elements may contain eye attracting matters, like names, slogans, pictures, decals, advertisements, etc.

8 Claims, 8 Drawing Figures

SUNSHADE—FOLDABLE AND HAND-TRANSPORTABLE

CROSS-REFERENCE TO RELATED APPLICATION

This application is a continuation-in-part of my copending U.S. Application Ser. No. 687,539, filed May 18, 1976, now abandoned.

The following will demonstrate the characteristics, the new additional applications and advantages of this invention, and finally, the new and simpler ways of construction and operation, the increased efficiency in its shielding function, the lower manufacturing cost because of fewer and less complicated parts compared to known devices of similar purpose as shown in U.S. Pat. Nos. 3,441,038, 3,305,201, 2,932,833, 2,828,758 and 2,561,931.

DESCRIPTION OF THE PREFERRED EMBODIMENTS

Figure 1:
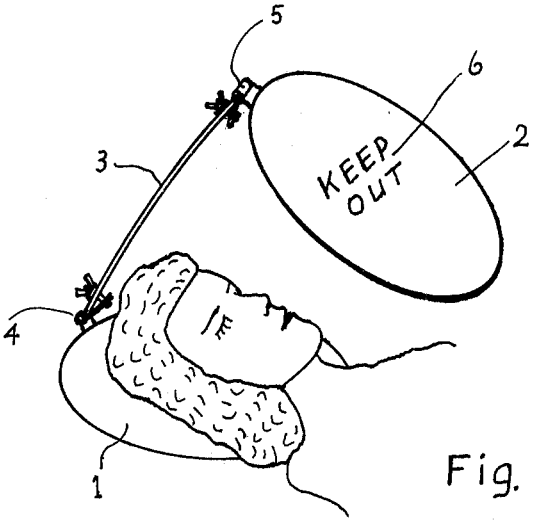
FIG. 1 is a perspective view of the invention as being used by a person, for example on a beach.

FIG. 1 shows the simplest and basic idea of the invention. The protection of a person's face in the course of sunbathing, by a shield 2 against sunburning, while the weight of a person's head is resting on the base 1 to secure the invention by way of example, on the sand at a beach or on the lawn in a park, in the necessary position. A supporting rod 3, is equipped with two hinge-like clamp-joints 4 and 5 at each end. The base 1 and the shield 2 have been mounted onto the frames 8 and 9 which in turn represent part of the clamp-joints 4 and 5 as described in FIGS. 4 and 7. Clamp-joint 4 provides herewith orbital adjustment to any desired position. More complete adjustment and function will be described with FIG. 6.

The base and shield may be of different materials, preferably plastic or cardboard. They may be of different sizes, shapes and colors, depending on the consumer's request. The frames may be of different materials, preferably non-rusting or non-corroding metal rods. They may be of different sizes or shapes depending on the design of the bases and shields. The rod may be of different materials, preferably non-rusting or non-corroding metal rods.

Figure 2:
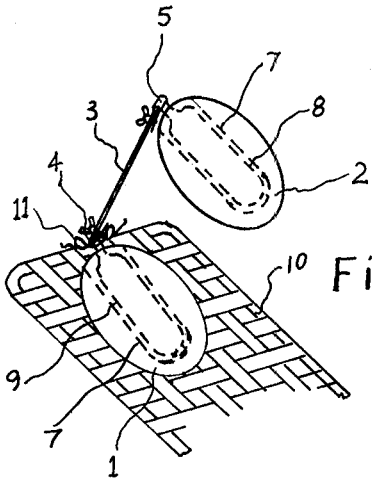
FIG. 2 is a perspective view of the invention as being attached to a lounge 10 or a lawn chair.

FIG. 2 shows the invention by way of example being attached to the backrest 10 of a lounge or lawnchair, by means of tying the clamp-joint 4 with a ribbon 11 to the upper part of said backrest.

Base 1 and shield 2, have been provided each with a pocket-like sheath 7, which serves to shove the base 1 and shield 2 onto the frames 8 and 9. The sheaths are sized to fit snugly over said frames, with enough friction to keep them from falling off.

Further, FIG. 2 shows that the base 1 and shield 2 are of the same principal design, also recognizable from FIGS. 1, 4, 5 and 6, and may be used for the same purpose. Which means, base 1 may serve as a shield 2, while shield 2 may serve as a base, or vice versa.

Therefore, to simplify the remaining descriptions and claims, the base will be called "shield" unless otherwise specified. However, the shield may be of different sizes, in particular the outside dimensions. They may be of different materials, different shapes, colors, etc. Furthermore, both surfaces of each shield may be plain or contain eye attracting matters, like advertisings, slogans, pictures, decals, names of persons, messages, and in particular on beaches or other public places, communicating writings or fun patches, like for instance, "Girl Wanted", "Let's Boogie", or even a phone number, etc. For example, "Keep Out" 6 in FIG. 1.

All of this may be either imprinted, painted, or attached. Both surfaces of each shield may be used as above because the inside dimensions of the sheath 7 are symmetrical to the shield's outside dimensions. This makes it possible to pull the shield off the frame 8 or 9, or exchange it for another one, dispose of it, store it, or reverse it and shove it back onto the frame within seconds.

Figure 3:
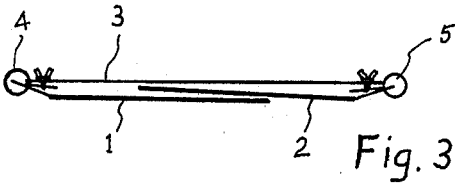
FIG. 3 is a symbolised side elevation of the invention in a folded position.

FIG. 3 shows the invention in a folded position. The folding can be accomplished by releasing the locking action of the clamp-joints 4 and 5 and swinging the frames 8 and 9 including the shields 1 and 2 around the axis of said clamp-joints toward the rod 3, until they come to rest alongside said rod 3. Thereafter, the clamp-joints 4 and 5 may remain locked to keep the shields in that folded position. If for any reason the shields 1 and 2 shall be removed from the frames 8 and 9, for instance for shipping by manufacturers, safer storage or disposal by consumers, the folded remaining assembly will be even lighter and more compact.

Figure 4:
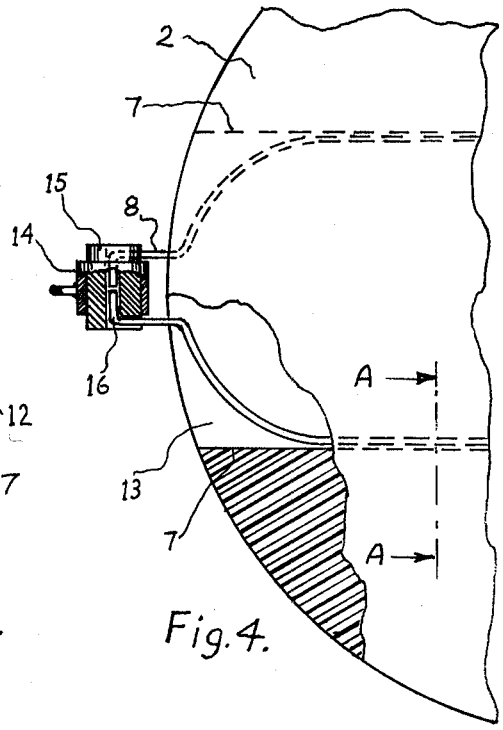
FIG. 4 is a partial top plan view of FIG. 2, with sectional detail views of shield 2, and the clamp joint 5, taken approximately on the plane of line E — E of FIG. 7.

FIG. 4 shows a portion of shield 2 with its sheath 7 and a portion of the frame 8. Both ends of said frame have been formed to hooks 16, for the purpose of anchoring inside the cylindrical pivot 15, which consists of a material with good frictional characteristics, like plastic or aluminum.

Figure 7:
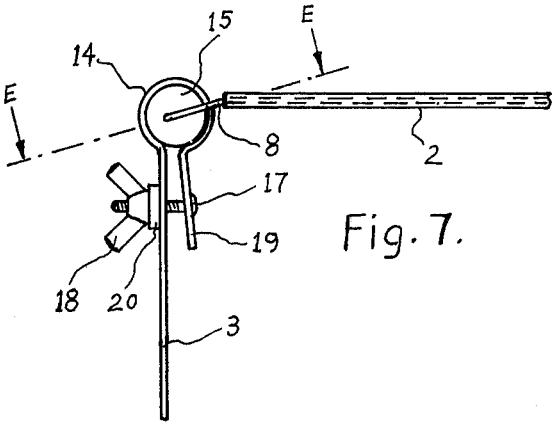
FIG. 7 is a side elevation of FIG. 4.

FIG. 7 shows part of the shield 2, part of the frame 8, anchored in pivot 15, and the upper portion 14, of rod 3, which is formed strap-like around the pivot 15 and extending downwards to a suitable length 19. The length 19 and the rod 3 have been connected by means of a carriage-bolt 17, a wing-nut 18 and a washer 20. It will be noted that the direction of turn of the rod 3 around pivot 15 is such that the down-bearing weight of shield 2 due to gravity causes a tightening of the joint 5. This assembly represents the clamp-joint 5. The clamp-joint 4 at the other end of rod 3, is of the same design and in symmetrical position. The design and the frictional gripping function of this assembly is well known, except the way of anchoring the hooks 16 inside the pivots 15.

Figure 8:
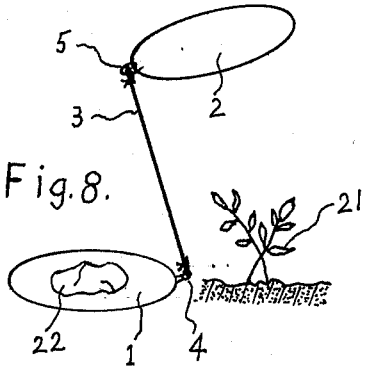
FIG. 8 is a perspective view of the invention as being used to protect sensitive flowers from direct sunlight.
Figure 5:
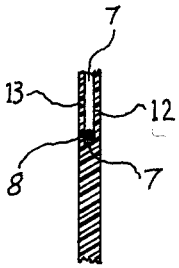
FIG. 5 is a sectional detail view taken along line A — A of FIG. 4.

Each clamp-joint 4 and 5 has an angular adjustability of over 300°, which makes it possible to place shield 1 in opposite direction to shield 2, as shown necessary in FIG. 8. Any suitable object heavy enough, for instance a rock 22, may be placed on top of shield 1 to secure the invention in its adjusted position. Referring back to FIG. 1, the same method can be used, if for any reason a person prefers, not to rest the head on shield 1.

Figure 6:
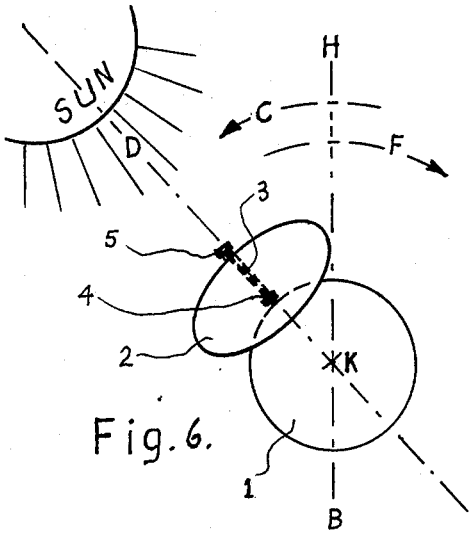
FIG. 6 is a top view of FIG. 1, with its base 1 rotated, to position the rod 3 and shield 2 in direction to the sun D.

FIG. 6 demonstrates the possibility to adjust shield 2, to any angle of incidence of the sunrays. The line H - B represents the directional position of a person, using the invention. Shield 1 lying flat on the ground can be rotated 360°around its center K, in either direction C or F. For example FIG. 6 shows shield 1 has been rotated in direction C in relation to line H - B, whereby rod 3 has been positioned on a common line between the sun D and the center K of shield 1.

By means of the pivotable clamp-joints 4 and 5, the flat surface of shield 2 can now be adjusted perpendicular to any angular incidence of the sunrays.

In the drawings and specification there have been disclosed preferred forms of the invention, and although specific terms are employed these are used in a generic sense and not for purposes of limitation, the scope of invention being defined in the following claims.

I claim:

1. Shielding means particularly suitable for use by an individual as a sunshade for his face, comprising:

first generally flat shield means;

second generally flat shield means;

rigid, elongate means formed into a first loop configuration at one end and a second loop configuration at the other end;

first cylindrical means adapted to fit snugly within said first loop configuration;

second cylindrical means adapted to fit snugly within said second loop configuration;

said first generally flat shield means and said first cylindrical means being adapted for interconnection in use whereby the first cylindrical means seated in said first loop configuration serves as a pivot for fan-like adjustment of the first shield means around said one end of said rigid elongate means;

said second generally flat shield means and said second cylindrical means being adapted for interconnection in use whereby the second cylindrical means seated in said second loop configuration serves as a pivot for fan-like adjustment of the second shield means around said other end of said rigid elongate means;

said rigid, elongate means including manual loop size adjusting means to permit independent adjustment of the loop size at each of its end loop configurations;

each of said shield means being rotatable in use around its pivot through at least 300° of rotation;

the parts of said shielding means cooperating so that when it is in use one of the generally flat shield means can be held flush against a horizontal surface by weight means, said rigid elongate means can extend upwardly therefrom at any of various angular adjustments and the other shield means can be adjusted to a position of outward extension from said rigid elongate means at any of a variety of angular positions with respect to the latter;

the loop configuration at the pivot of said other shield means being of such character that the weight of that shield means acting through frictional contact of its cooperating cylindrical means with said loop configuration has a tendency to cause tightening of the latter around said cylindrical means which serves to resist downward movement of said other shield means about its pivot under the force of gravity during normal usage of the shielding means by a sunbather.

2. Shielding means in accordance with claim 1 in which at least one of said generally flat, shield means comprises a skeletal frame of generally flat form and a flattened plate-like member with a hollow central pocket running transversely thereacross from one edge, the size of said pocket being such as to snugly receive the skeletal frame in sufficiently tight friction-fit relationship therewith to insure retention of the plate-like member on the frame during normal usage of the shielding means, whereby separate plate-like members can be interchangeably employed on the shielding means by manual substitution of one for another on said skeletal frame.

3. Shielding means in accordance with claim 2 in which each of said generally flat, shield means comprises an interfitting skeletal frame and flat plate-like member such as set forth in that claim.

4. Shielding means in accordance with claim 3 in which the two generally flat, shield-like means are adapted to fold flush against each other adjacent the same side of the rigid, elongate means to provide a compact arrangement for ease of handling.

5. Shielding means in accordance with claim 4 in which said skeletal frame is of generally oval configuration and formed from heavy wire stock, and in which the pocket in said plate-like shield member is sized to receive said oval skeleton in sufficiently tight fitting relationship to permit frictional contact between the sides of the oval and the side edges of the pocket, and in which the thickness of said pocket is such that there is frictional contact between the confronting walls of the pocket and the faces of said skeletal means.

6. Shielding means in accordance with claim 5 in which said skeletal frame is removably securable to its cooperating cylindrical means whereby the shielding means can be easily disassembled and reassembled as desired.

7. Shielding means in accordance with claim 5 in which at least one of the loop configurations of said rigid, elongate means comprises a single loop of an end segment thereof and in which said end segment extends away from said loop configuration a relatively short distance in spaced apart relationship with the main portion of said rigid elongate means on the side of the latter from which the upper shield means extends during normal usage of said shielding means by a sunbather, and in which said rigid elongate means is adapted to receive a bolt and wing nut to permit the manual drawing of the end segment extension toward said main portion of said rigid elongate means to tighten said ring configuration, whereby the downbearing weight of said upper shield means exerts ring tightening influence on said ring configuration through frictional contact of its cooperating cylindrical means seated therein to counteract downward drooping of said upper shield means.

8. Shielding means in accordance with claim 7 in which the two generally flat shield means are pivoted to said rigid elongate means in similar fashion.

* * * * *